US006401797B1

(12) United States Patent
Nitz et al.

(10) Patent No.: US 6,401,797 B1
(45) Date of Patent: Jun. 11, 2002

(54) MOLD AND METHOD FOR CASTING A VEHICLE WHEEL

(75) Inventors: John D. Nitz, Livonia; Jiang Z. Shi, Canton, both of MI (US)

(73) Assignee: Hayes Lammerz International, Inc., Northville, MI (US)

( * ) Notice: Subject to any disclaimer, the term of this patent is extended or adjusted under 35 U.S.C. 154(b) by 0 days.

(21) Appl. No.: 09/469,990

(22) Filed: Dec. 22, 1999

(51) Int. Cl.[7] ..... B22D 27/04; B22D 33/04
(52) U.S. Cl. ..... 164/122; 164/122.1; 164/339
(58) Field of Search ..... 164/122, 122.1, 164/339, 342

(56) References Cited

U.S. PATENT DOCUMENTS

| | | | | |
|---|---|---|---|---|
| 3,964,144 A | | 6/1976 | Kopp | |
| 4,200,326 A | * | 4/1980 | Wilcoz | 295/23 |
| 4,436,133 A | | 3/1984 | Rohr | |
| 4,453,776 A | | 6/1984 | Rohr | |
| 5,320,160 A | | 6/1994 | Kato et al. | |
| 5,381,852 A | | 1/1995 | Schilling | |
| 5,427,171 A | | 6/1995 | Prieto | |
| 5,527,101 A | | 6/1996 | Kato et al. | |
| 5,647,426 A | | 7/1997 | Prieto et al. | |
| 5,722,165 A | | 3/1998 | Kobayashi et al. | |
| 5,810,067 A | * | 9/1998 | Atari et al. | 164/120 |
| 5,896,912 A | | 4/1999 | Monroe et al. | |

* cited by examiner

*Primary Examiner*—M. Alexandra Elve
*Assistant Examiner*—Len Tran
(74) *Attorney, Agent, or Firm*—MacMillan, Sobaski & Todd, LLC

(57) ABSTRACT

A mold for casting a vehicle wheel includes a plurality of mold members that cooperate to define a mold cavity. The mold cavity includes an annular rim cavity for casting a wheel rim and a disc cavity for casting a wheel disc. The mold members define a central axis and have a passageway for introducing molten metal into the rim cavity. The rim cavity has a radial width that changes in a circumferential direction between a maximum width portion of the rim cavity located proximally relative to the passageway, and a minimum width portion of the rim cavity located distally relative to the passageway. In a method for casting a vehicle wheel, a mold as described above is provided. Molten metal is introduced through the passageway into the rim cavity to fill the mold cavity and form a wheel casting. The wheel casting is allowed to cool sufficiently to solidify the metal. The changing width of the rim cavity causes a thermal gradient in the molten metal such that solidification proceeds in a circumferential direction from the minimum width portion of the rim cavity to the maximum width portion of the rim cavity. The solidified wheel casting is removed from the mold.

13 Claims, 4 Drawing Sheets

MOLD AND METHOD FOR CASTING A VEHICLE WHEEL

BACKGROUND OF THE INVENTION

This invention relates in general to cast vehicle wheels and in particular to a mold for casting a vehicle wheel, and a method for casting a vehicle wheel by use of the mold.

Cast wheels formed from light weight metal alloys are replacing steel wheels on an increasing number of vehicles. Such cast wheels provide both a reduction in weight from steel wheels and an attractive appearance. Cast wheels are cast by introducing a molten metal, typically an alloy of a light weight metal, such as aluminum, magnesium or titanium, into a wheel mold to form a wheel casting. The wheel casting is allowed to cool to solidify the metal, and the solidified wheel casting is removed from the mold.

A traditional wheel mold includes a base member that supports the other pieces of the mold. Two or more retractable side members are carried by the base member. A removable cup-shaped top member is disposed within the side members. Upon assembly, the base, top and side members cooperate to define a mold cavity wherein the wheel casting is cast. The mold cavity includes an annular rim cavity for casting the wheel rim and a disc cavity for casting the wheel disc. The rim cavity has a uniform radial width around the circumference of the rim cavity.

SUMMARY OF THE INVENTION

The traditional wheel mold, having a rim cavity with a uniform radial width, is not always effective in solidifying the molten metal forming the wheel rim. As the molten metal solidifies, a crystalline structure consisting of individual metal grains is formed in the wheel rim. If the molten metal solidifies too slowly, a large grain structure is formed that is relatively weak and, porous compared to the smaller grain structures formed during rapid solidification. The use of a rim cavity having a uniform radial width can result in slow crystallization of portions of the wheel rim, causing these portions to be relatively weak and porous. A wheel rim having weak portions is unsuitable for use on a vehicle, so that the wheel rim must be scrapped. High porosity of the wheel rim can allow escape of the pressurized air contained in a tire mounted on the finished wheel. In view of the problems associated with the traditional wheel mold, it would be desirable to provide a mold for casting a vehicle wheel that is more effective in solidifying the wheel rim, and a method for casting a vehicle wheel by use of such a mold.

The present invention relates to a mold for casting a vehicle wheel, including a plurality of mold members that cooperate to define a mold cavity. The mold cavity includes an annular rim cavity for casting a wheel rim and a disc cavity for casting a wheel disc. The mold members define a central axis and have a passageway for introducing molten metal into the rim cavity. The rim cavity has a radial width that changes in a circumferential direction between a maximum width portion of the rim cavity located proximally relative to the passageway, and a minimum width portion of the rim cavity located distally relative to the passageway.

The invention also relates to a method for casting a vehicle wheel. A mold as described above is provided. Molten metal is introduced through the passageway into the rim cavity to fill the mold cavity and form a wheel casting. The wheel casting is allowed to cool sufficiently to solidify the metal. The changing width of the rim cavity causes a thermal gradient in the molten metal such that solidification proceeds in a circumferential direction from the minimum width portion of the rim cavity to the maximum width portion of the rim cavity. The solidified wheel casting is removed from the mold.

Various objects and advantages of the invention will become apparent to those skilled in the art from the following detailed description of the preferred embodiments, when read in light of the accompanying drawings.

DETAILED DESCRIPTION OF THE PREFERRED EMBODIMENT

Figure 1:
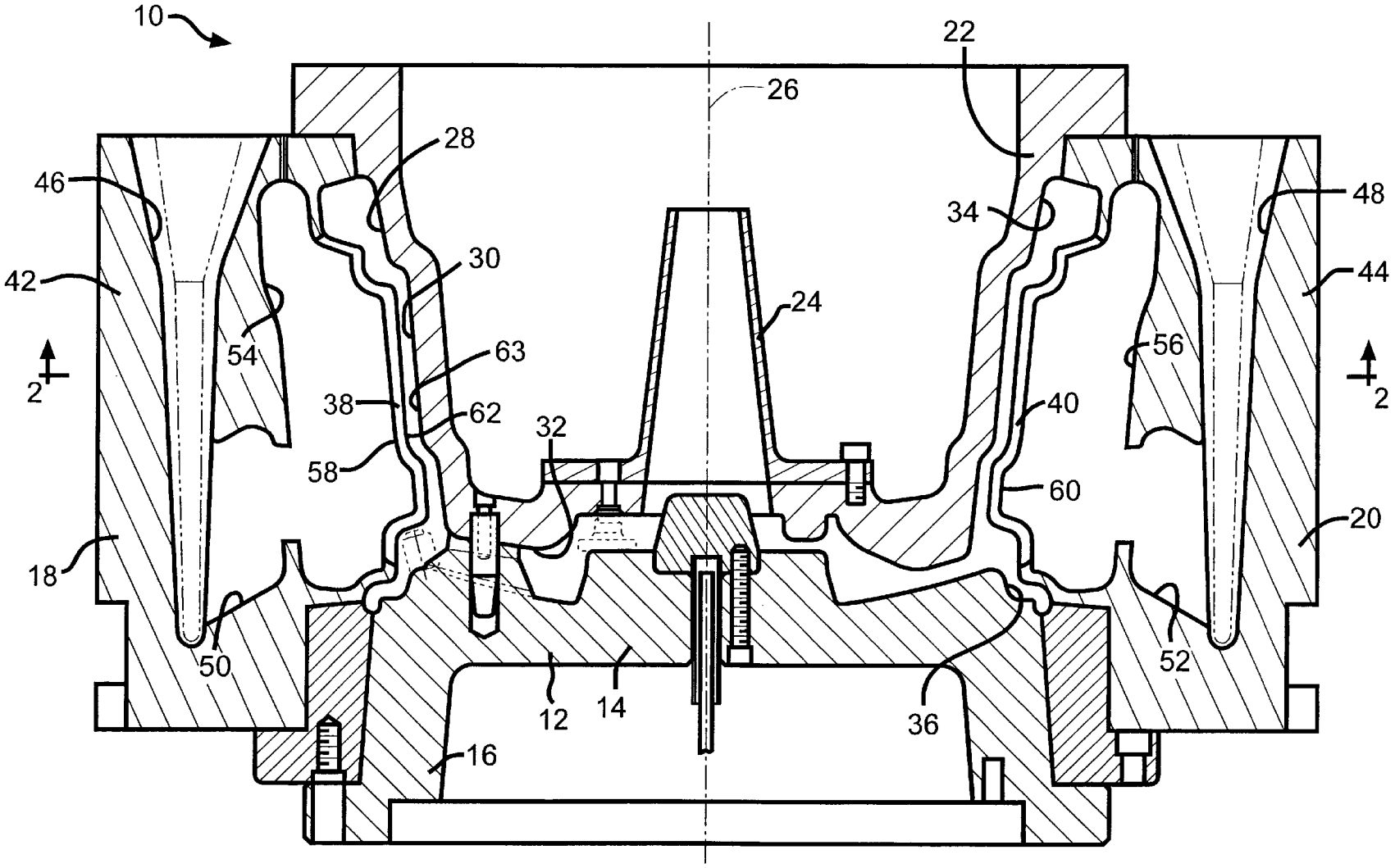
FIG. 1 is a sectional view of a mold for casting a vehicle wheel in accordance with the invention.

Referring now to the drawings, there is illustrated in FIG. 1 a mold 10 for casting a vehicle wheel in accordance with the invention. The mold 10 includes a plurality of mold members or pieces that cooperate to define a mold cavity for casting the vehicle wheel. The individual pieces of the mold 10 are typically formed from cast iron or high carbon steel, although they can be formed from any material suitable for casting the vehicle wheel.

The illustrated mold 10 includes a base member 12 that supports the other pieces of the mold. The base member 12 has a disc-shaped upper portion 14 mounted on a ring-shaped lower portion 16. Two or more retractable side members are carried by the base member 12. In the embodiment shown, the mold includes two retractable side members: a first side member 18 and a second side member 20. A removable cup-shaped top member 22 having a cylindrical center portion 24 is disposed within the side members 18, 20. The top member 22 defines a central axis 26 of the mold 10.

Upon assembly, the mold members cooperate to define a mold cavity 28 wherein the wheel casting is cast. The mold cavity 28 includes an annular rim cavity 30 for casting the wheel rim and a disc cavity 32 for casting the wheel disc. An annular rim riser cavity 34 is defined adjacent to the rim cavity 30. For purposes of this invention, the rim riser cavity 34 is considered part of the rim cavity 30. An annular sidewall cavity 36 for casting the wheel sidewall joins the rim cavity 30 to the disc cavity 32.

The mold 10 has at least one passageway for introducing molten metal into the rim cavity 30. Preferably, it has a plurality of passageways, usually either two or three passageways. In the illustrated embodiment, the mold 10 has first and second gate passageways 38, 40 for introducing molten metal into the rim cavity 30. The illustrated first and second gate passageways 38, 40 are vertically extending slots formed through the outer wall 62 of the rim cavity 30. In a preferred embodiment, the slots are about 8–10 millimeters wide. The first and second side members 18, 20 include first and second gate members 42, 44, respectively. The first and second gate members 42, 44 include inlet chambers 46, 48 which communicate with intermediate chambers 50, 52, which in turn communicate with inner chambers 54, 56. The first and second gate passageways 38, 40 are formed through the inner walls 58, 60 of the inner chambers 54, 56 (the outer wall 62 of the rim cavity 30).

Thus, in the illustrated embodiment, the first and second gate passageways 38, 40 are oriented in a radial direction relative to the rim cavity 30.

During a casting operation, molten metal is introduced through the first and second gate passageways 38, 40 into the rim cavity 30 to fill the mold cavity 28 and form a wheel casting. The molten metal can be introduced by any suitable method, such as by gravity feeding or pressure injection. In the illustrated embodiment, the molten metal is poured into the inlet chambers 46, 48 of the first and second gate members 42, 44, and flows by gravity through the intermediate chambers 50, 52 to fill the inner chambers 54, 56. The molten metal flows through the first and second gate passageways 38, 40 into the rim cavity 30.

Figure 2:
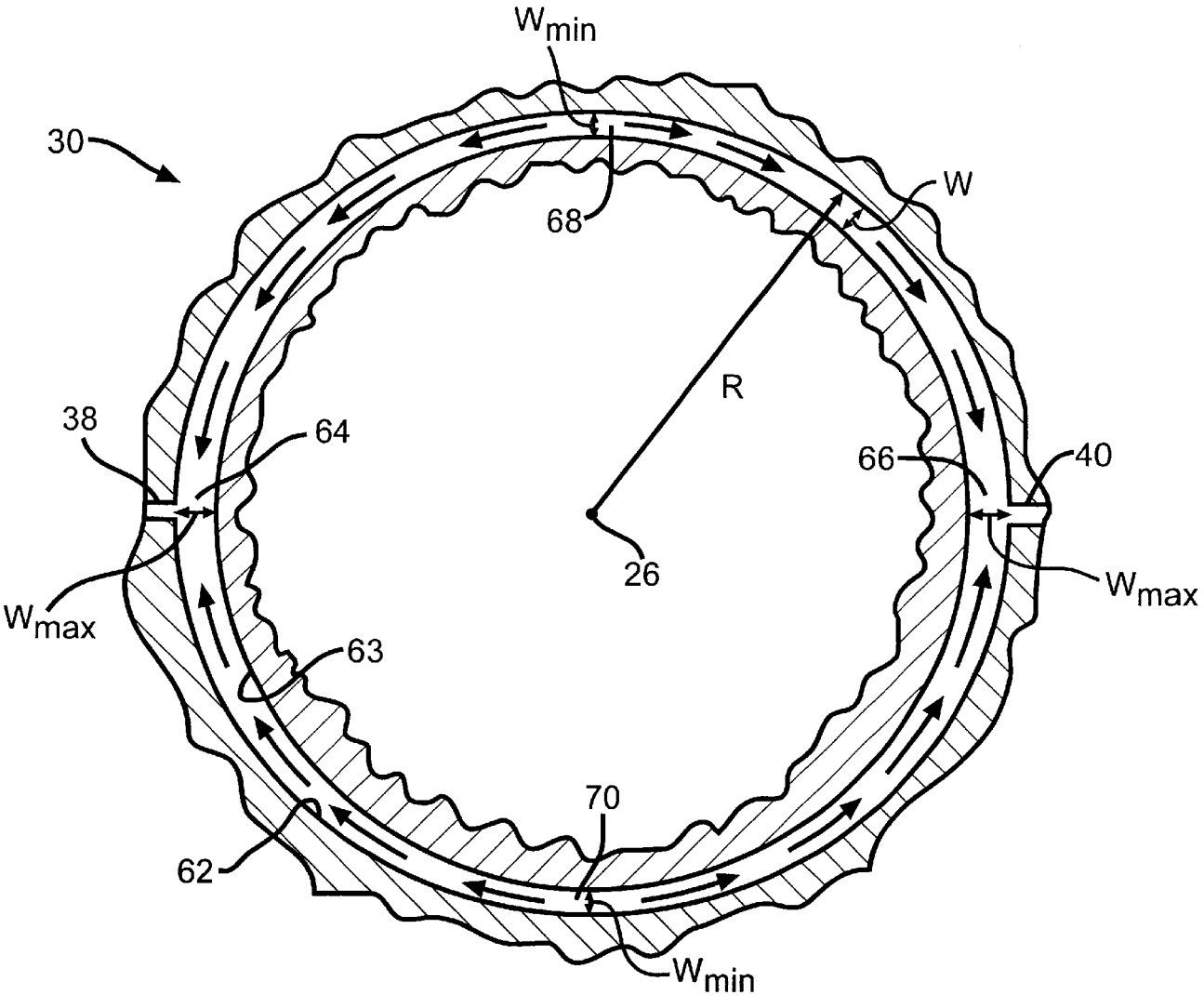
FIG. 2 is a fragmentary sectional view of a rim cavity of the mold, taken along line 2—2 of FIG. 1.

As shown in FIG. 2, the rim cavity 30 is annular in shape, and is defined by an inner wall 63 and an outer wall 62. In the embodiment shown in FIG. 2, the inner wall 63 has a circular cross-section while the outer wall 62 has an elliptical cross-section. When the mold 10 includes a plurality of passageways for introducing molten metal, the passageways are preferably equally spaced about the rim cavity 30 in the circumferential direction. In the illustrated embodiment, the first and second gate passageways 38, 40 are located on opposing sides of the rim cavity 30.

The rim cavity 30 has a radial width W that is measured along a radius R extending perpendicular to the central axis 26, at any location around the circumference of the rim cavity 30. In accordance with the present invention, the radial width of the rim cavity 30 changes in a circumferential direction between at least one maximum width portion of the rim cavity 30 and at least one minimum width portion of the rim cavity 30. In the illustrated embodiment, the rim cavity includes first and second maximum width portions 64, 66 and first and second minimum width portions 68, 70. The number of each of the maximum width portions and minimum width portions (two each in the illustrated embodiment) is equal to the number of passageways for introducing molten metal into the rim cavity 30 (first and second gate passageways 38, 40 in the illustrated embodiment).

The maximum width portions 64, 66 of the rim cavity 30 are located proximally relative to the gate passageways 38, 40, while the minimum width portions 68, 70 of the rim cavity 30 are located distally relative to the passageways 38, 40. By "proximally", as used herein, is meant that each maximum width portion 64 and 66 is located close to a passageway 38 or 40, usually within about 10° in either circumferential direction from the passageway. 38 or 40. Preferably, the maximum width portions 64, 66 are located adjacent to the passageways 38, 40. By "distally", as used herein, is meant that each minimum width portion 68 and 70 is located distant from the passageway(s) 38 and 40, usually within about 20° in either circumferential direction from a point located as far as possible from the passageway(s) 38 and 40. In the illustrated embodiment, the first and second maximum width portions 64 and 66 of the rim cavity 30 are located adjacent to the first and second gate passageways 38 and 40, respectively. The first minimum width portion 68 is located equidistantly between the first and second gate passageways 38 and 40 on one side of the rim cavity 30, and the second maximum width portion 70 is located equidistantly between the first and second gate passageways 38 and 40 on the opposite side of the rim cavity 30.

The radial width of each maximum width portion of the rim cavity is preferably at least about 30% greater than the radial width of each minimum width portion of the rim cavity, and more preferably at least about 60% greater. In the illustrated embodiment, the radial width $W_{max}$ of each maximum width portion 64, 66 of the rim cavity 30 is about 100% greater than the radial width $W_{min}$ of each minimum width portion 68, 70 (i.e., the maximum width portions 64, 66 are about twice as wide as the minimum width portions 68, 70).

Preferably, the radial width of the rim cavity changes gradually between the maximum width portion(s) of the rim cavity and the minimum width portion(s) of the rim cavity. In the illustrated embodiment, the radial width W of the rim cavity 30 changes continuously and gradually between the maximum width portions 64, 66 and the minimum width portions 68, 70.

Figure 3:
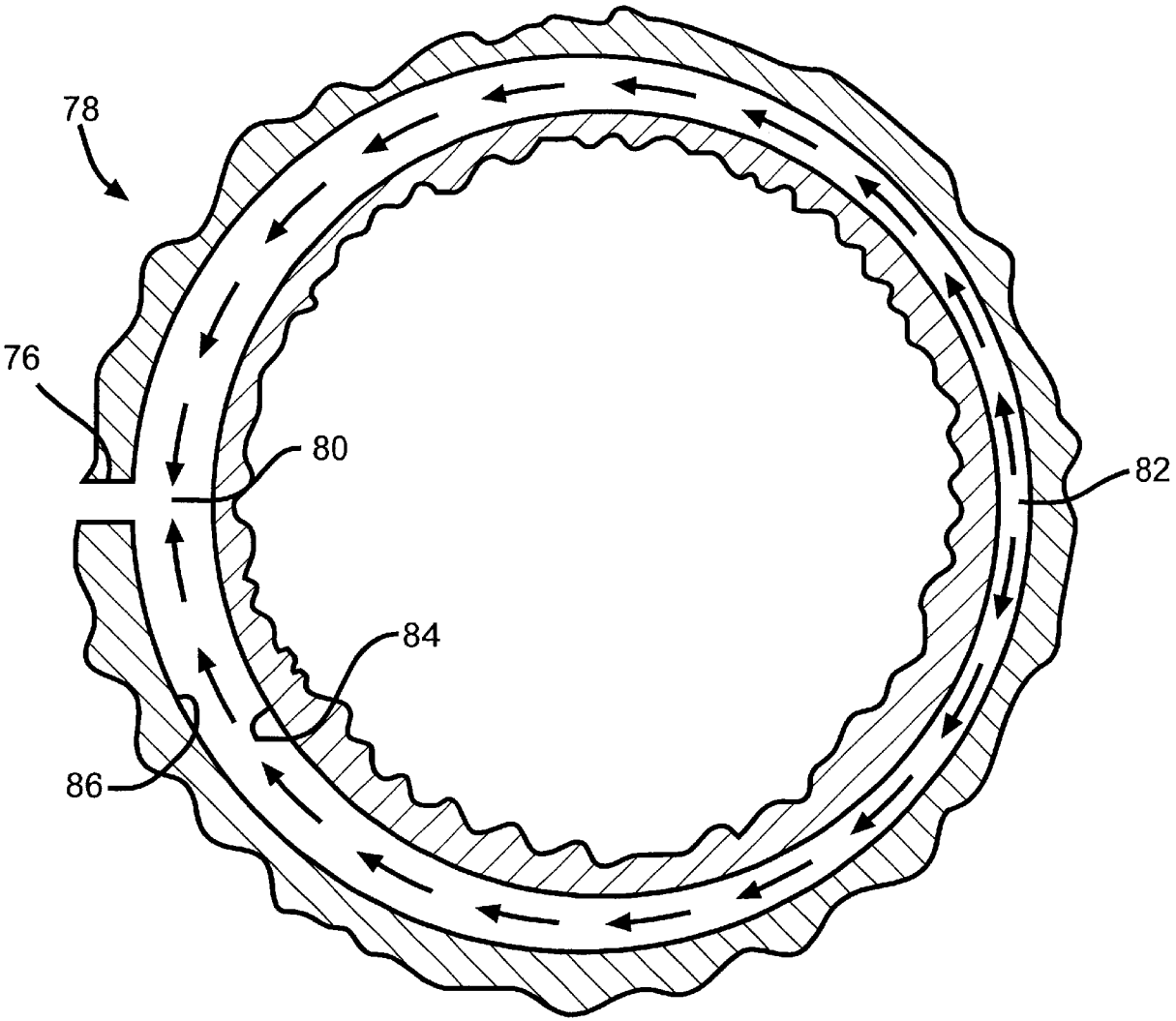
FIG. 3 is a fragmentary sectional view of an alternate embodiment of the rim cavity of FIG. 2.

FIG. 3 illustrates an alternate embodiment of the invention in which the rim cavity 78 is defined by an inner wall 84 and an outer wall 86. Both the inner wall 84 and the outer wall 86 have a circular cross-section; however, the circles are not concentric. The mold has one gate passageway 76 for introducing molten metal into the rim cavity 78, and the rim cavity 78 has one maximum width portion 80 and one minimum width portion 82. The maximum width portion 80 is located proximally relative to the gate passageway 76 (adjacent to the gate passageway 76), and the minimum width portion 82 is located distally relative to the gate passageway 76 (at a point in the circumference opposite the gate passageway 76).

After the molten metal is introduced into the rim cavity to form a wheel casting, the wheel casting is allowed to cool sufficiently to solidify the metal. As discussed above, the traditional wheel mold, having a rim cavity with a uniform radial width, is not always effective in solidifying the molten metal. The molten metal may solidify too slowly in portions of the wheel rim, producing rim portions that are relatively weak and porous. As shown in FIG. 2, the mold of the present invention overcomes this problem by providing the rim cavity 30 having a radial width W that changes between the maximum width portions 64, 66 and the minimum width portions 68, 70. The molten metal in the minimum width portions 68, 70 of the rim cavity 30 cools more rapidly than the molten metal in the maximum width portions 64, 66, creating a thermal gradient in the molten metal between the minimum width portions 68, 70 and the maximum width portions 64, 66 during solidification of the molten metal.

The thermal gradient causes the solidification of the molten metal to proceed rapidly in a circumferential direction from the minimum width portions 68, 70 of the rim cavity 30 to the maximum width portions 64, 66. The arrows in FIG. 2 illustrate the directional solidification of the molten metal. The solidification of the molten metal in a circumferential direction ensures that all portions of the wheel rim are solidified rapidly, so that the resulting wheel rim has a high structural strength and a low porosity. Similar arrows illustrating the directional solidification of the molten metal in the alternate embodiment of the rim cavity 78 are shown in FIG. 3.

Figure 4:
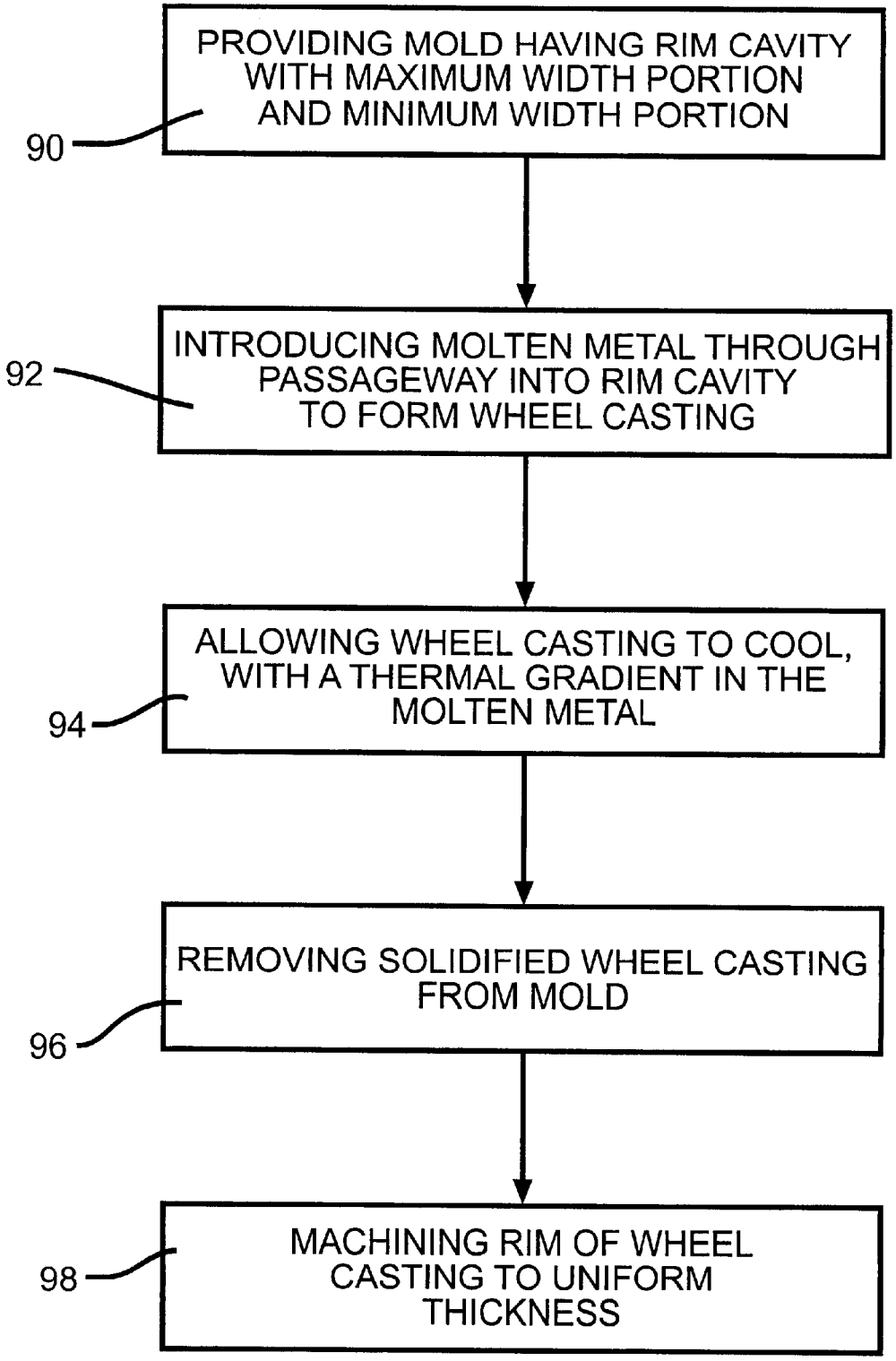
FIG. 4 is a flow chart of a method for casting a vehicle wheel in accordance with the invention.

FIG. 4 is a flow chart of the method for casting a vehicle wheel in accordance with the invention. First of all, in functional block 90, a mold as described above is provided. In functional block 92, molten metal is introduced through the passageway into the rim cavity to fill the mold cavity and form a wheel casting. In functional block 94, the wheel casting is allowed to cool sufficiently to solidify the metal. The changing width of the rim cavity causes a thermal gradient in the molten metal such that solidification proceeds in a circumferential direction from the minimum width portion of the rim cavity to the maximum width portion of the rim cavity. In functional block 96, the solidified wheel casting is removed from the mold. Lastly, in functional block 98, the rim of the wheel casting is machined to a uniform thickness (not shown), by any suitable method such as a wheel lathe.

In accordance with the provisions of the patent statutes, the principle and mode of operation of this invention have been explained and illustrated in its preferred embodiments. However, it must be understood that this invention may be practiced otherwise than as specifically explained and illustrated without departing from its spirit or scope.

What is claimed is:

1. A mold for casting a vehicle wheel comprising:

a plurality of mold members that cooperate to define a mold cavity for casting the vehicle wheel, the mold cavity including an annular rim cavity for casting a wheel rim and a disc cavity for casting a wheel disc, the mold members defining a central axis and having a passageway for introducing molten metal into the rim cavity;

the rim cavity having a radial width that lies in a plane generally perpendicular to said central mold axis and that changes in a circumferential direction between a maximum width portion of the rim cavity located proximally relative to the passageway and a minimum width portion of the rim cavity located distally relative to the passageway whereby solidification of a charge of molten metal contained in said rim cavity proceeds in a circumferential direction from said minimum width portion of said cavity toward said maximum width portion of said cavity and within said plane that is generally perpendicular to said central mold axis.

2. A mold according to claim 1 wherein the mold members comprise a base member, a top member defining the central axis, and a plurality of arcuate-shaped side members, and wherein one of the side members has the passageway.

3. A mold according to claim 2 wherein the width of the rim cavity changes gradually between the maximum width portion of the rim cavity and the minimum width portion of the rim cavity.

4. A mold according to claim 3 wherein the maximum width portion of the rim cavity is at least about 30% greater than the width of the minimum portion of the rim cavity.

5. A mold according to claim 3 wherein the rim cavity is defined by an inner wall having a circular cross-section and an outer wall having a circular cross-section, and further wherein the circular cross-sections are not concentric.

6. A mold for casting a vehicle wheel comprising:

a plurality of mold members that cooperate to define a mold cavity for casting the vehicle wheel, the mold cavity including an annular rim cavity for casting a wheel rim and a disc cavity for casting a wheel disc, the mold members defining a central axis and having a plurality of passageways for introducing molten metal into the rim cavity;

the rim cavity having a radial width that lies in a plane generally perpendicular to said central mold axis and that changes in a circumferential direction between a plurality of maximum width portions of the rim cavity located proximally relative to the passageways and a plurality of minimum width portions of the rim cavity located distally relative to the passageways whereby solidification of a charge of molten metal contained in said rim cavity proceeds in a circumferential direction from said minimum width portion of said cavity toward said maximum width portion of said cavity and within said plane that is generally perpendicular to said central mold axis.

7. A mold according to claim 6 wherein the mold members comprise a base member, a top member defining the central axis, and a plurality of arcuate-shaped side members, and wherein the side members have the passageways.

8. A mold according to claim 7 wherein the width of the rim cavity changes gradually between the maximum width portions of the rim cavity and the minimum width portions of the rim cavity.

9. A mold according to claim 8 wherein the maximum width portions of the rim cavity is at least about 30% greater that the width of the minimum portions of the rim cavity.

10. A mold according to claim 8 wherein the rim cavity is defined by an inner wall having a circular cross-section and an outer wall having a noncircular cross-section.

11. A mold according to claim 7 wherein the passageways are equally spaced about the rim cavity in the circumferential direction.

12. A mold according to claim 9 wherein the mold members have two passageways, and further wherein the rim cavity has two maximum width portions located proximally relative to the passageways and two minimum width portions located distally relative to the passageways.

13. A mold according to claim 10 wherein said outer wall has an elliptical cross-section.

* * * * *